United States Patent [19]

Paige

[11] 3,941,354

[45] Mar. 2, 1976

[54] ANTI TWO-BLOCKING DEVICE

[75] Inventor: Marshall A. Paige, Clinton, Md.

[73] Assignee: The United States of America as represented by the Secretary of the Navy, Washington, D.C.

[22] Filed: Feb. 25, 1975

[21] Appl. No.: 552,896

[52] U.S. Cl. ..... 254/135 R; 24/132 R

[51] Int. Cl.[2] ..... B66D 1/00

[58] Field of Search ..... 254/135 R, 173 R, 190 R, 254/196; 30/175, 186, 189; 24/132 AA, 132 R, 134 KC, 134 N, 136 R; 294/103 R, 106

[56] References Cited

UNITED STATES PATENTS

| | | | |
|---|---|---|---|
| 3,116,049 | 12/1963 | Stranahan | 254/135 R |
| 3,446,484 | 5/1969 | Walsh et al. | 254/135 R |
| 3,824,653 | 7/1974 | Sholler | 254/135 R |

*Primary Examiner*—Albert J. Makay
*Assistant Examiner*—Kenneth Noland
*Attorney, Agent, or Firm*—R. S. Sciascia; Arthur L. Branning; Melvin L. Crane

[57] ABSTRACT

A fail-safe cable cutter device which prevents the release or loss of an object lifted by a cable through a pulley in the event the object accidentally strikes the pulley and is lifted beyond its safe load condition; i.e., the object is "two-blocked."

4 Claims, 10 Drawing Figures

ANTI TWO-BLOCKING DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to safety devices for use with power operated cargo hoisting equipment and particularly to devices which eliminate the hazards involved when the load hook is overwound to the extent that it engages the eye of the pulley.

During the operation of power driven load hoisting equipment, the winch operator must control the upper limit of movement of the load hook to stop the hook before it is "two-blocked," which is that condition which occurs when the hook is drawn into the eye of the pulley. If, through inadvertence or carelessness on the part of the winch operator, the load hook becomes "two-blocked," then either of two results may occur. The line may break and the load is dropped or, if the line does not break, the overhead boom upon which the pulley is mounted will collapse and both the boom and the load will fall. When either of these results occur, the safety of personnel in the area is greatly endangered and the load being hoisted is usually damaged. If the hoisting operation is being conducted over the side of a vessel, such as when raising oceanographic research instrumentation, the instrument package is lost over the side of the vessel when the line parts upon "two-blocking." In the past, various attempts have been made to prevent "two-blocking" by providing electrical switches which automatically control the extent to which a load may be hoisted. These switches operate to cut off the power to the winch when the load reaches a predetermined distance from the pulley. The electrical switches of this type have not been proven to be sufficiently reliable especially when used on shipboard load hoisting equipment where the switches are subjected to a corrosive salt spray which attacks the switch contacts and eventually renders the switch inoperative.

Further, this invention is an improvement over U.S. Pat. No. 3,446,484 which is directed to a fail-safe cable cutter device for load hoisting equipment. In this patent, the safety device must be threaded onto the cable before attaching the object to be hoisted which requires considerable lost time especially where the object has already been attached to the cable necessitating disconnecting and reconnecting the cable. Further, the fail-safe device is secured to the cable by use of a potting compound or a mechanical clamp, not shown in the patent.

SUMMARY OF THE INVENTION

This invention is directed to an improved fail-safe device for load hoisting equipment. The device is provided with a slot along its length which slot is sufficiently deep to place the cable along the linear axis of the device when mounted onto the cable. The fail-safe device is automatically provided with an eccentric-anvil clamping lever assembly which clamps the fail-safe device onto the cable with the cable positioned between the cable cutter and anvil upon assembly of the device onto the cable. A chain secured to the lower end of the fail-safe device and to the instrument connected onto the cable end prevents loss of the instrument in the event the fail-safe device is "two-blocked."

The device operates substantially as the device of U.S. Pat. No. 3,446,484 in order to prevent loss of the object secured to the cable. The patent exemplifies in FIGS. 1–4 the manner in which the device is "two-blocked" and saved. The cutter device of the present invention follows substantially the same steps as shown in the patent. Therefore, the operation steps, etc., of U.S. Pat. No. 3,446,484 are incorporated herein since they are essentially the same. The difference being in the construction and operation of the fail-safe cutter device.

This fail-safe cutter device has been described and shown in an article "A Fail-safe System to Prevent the Loss of 'Two-Blocked' Oceanographic Instruments" by Marshall A. Paige in EXPOSURE Vol. 2, No. 1, pp 1–3, March 1974 which is incorporated herein by reference.

BRIEF DESCRIPTION OF THE DRAWIGNS

DETAILED DESCRIPTION

Figure 3:
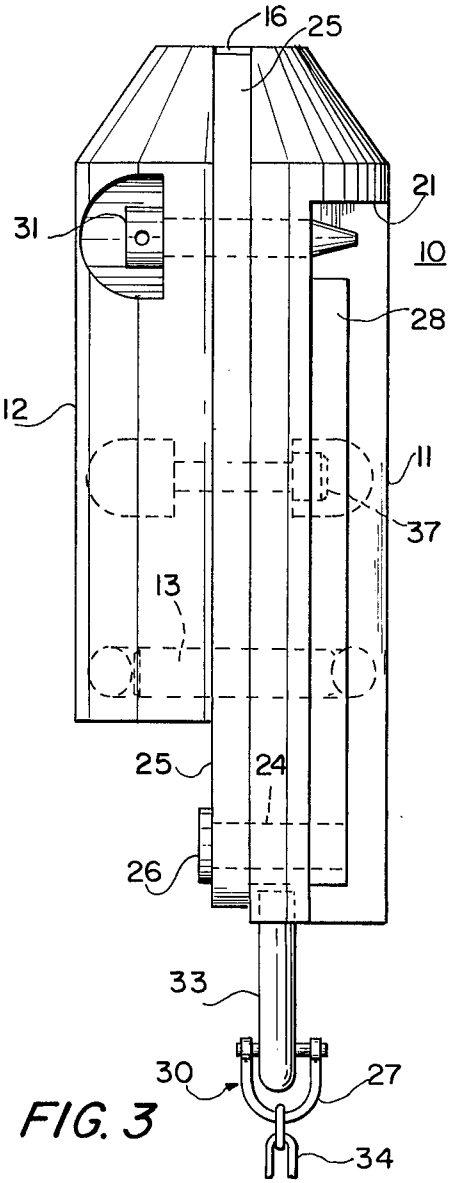
FIG. 3 is a side view from the opposite direction from that of FIG. 1.
Figure 2:
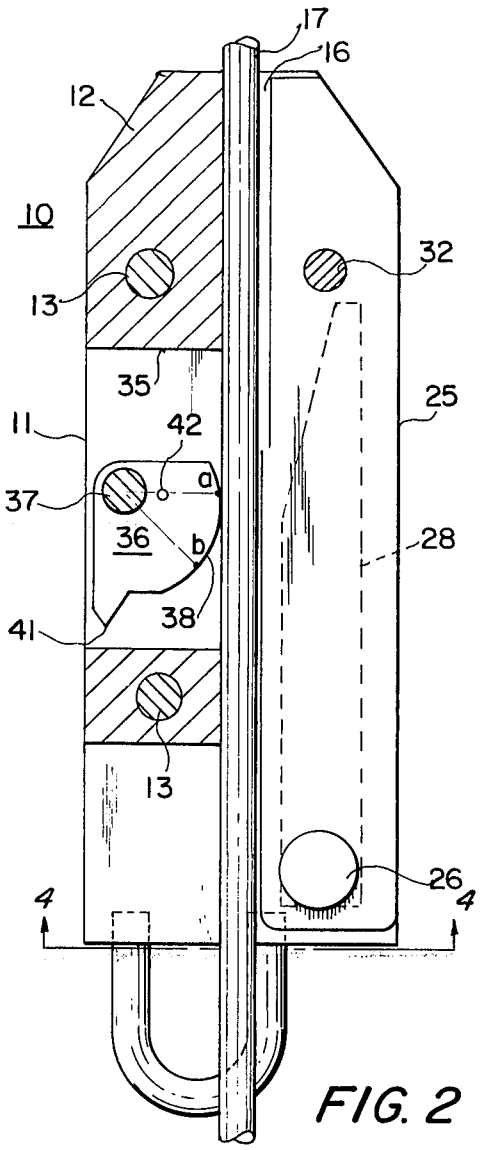
FIG. 2 is a partial cross sectional view toward one half taken along lines 2—2 of FIG. 1 illustrating the relative parts.
Figure 1:
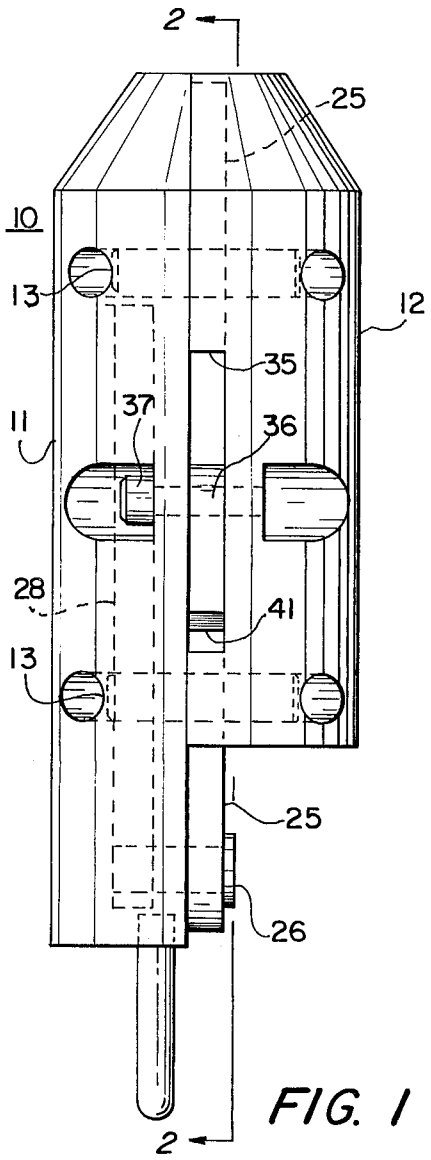
FIG. 1 is a side view of an assembled fail-safe cutter device.

Now referring to the drawings there is shown by illustration a fail-safe cutter device made in accordance with the teaching of this invention. FIGS. 1–5 illustrate different views of the cutter device, and FIGS. 6–10 illustrate the manner in which the device is secured onto the cable. Now referring to FIGS. 1–5 there is shown different views of the cutter device wherein like reference characters represent like parts throughout the drawings.

Figure 4:
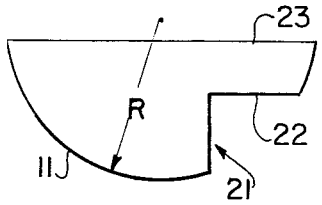
FIG. 4 is a cross sectional view of one half of the cylindrical device.
Figure 5:
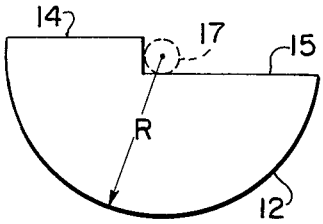
FIG. 5 is a cross sectional view of the other half-section.

The fail-safe cable cutter device 10 is formed by use of two substantially semi-cylindrical body sections 11 and 12 assembled together by use of screws, pins or bolts 13. The upper end of each section is cut at an angle to form a conical end section when the sections are assembled together. Semi-cylindrical body section 11 is formed with its circumferential surface having a radius slightly longer than that of its cross section, as shown in FIG. 4, and section 12 has an additional portion toward face 14 equal to the measure of which section 11 is less than a complete semi-cylinder, as shown in sectional view of FIG. 5. Semi-cylindrical body section 12 also has one facial surface 15 which has a radius less than a semi-cylinder. The face 14 has a width which is less than the width of the face 15. Thus, when the two semi-cylindrical sections are secured together, a slot 16 is formed in one side with its center on the axis of the cylinder and along its length. The depth of the slot is greater than the radius of the cylinder in order to assemble a cable 17 along the axis of the cutter device. The slot should be at least as wide as the diameter of the cable about which the fail-safe cable cutter is secured. Section 11 is longer in length than section 12.

Section 11 has a cutout 21 along a portion of its length to provide a flat face 22 parallel with the diametrical face 23 and is provided with a hole 24 near the bottom and top of the cutout. An anvil arm 25 is rotatably secured along the face 23 by an eccentric pin 26 that has a hole 27 through the end thereof to which a clamping arm 28 is secured on the cutout side 21 along flat face 22 by a suitable screw or pin. The clamping arm rotates the eccentric pin upon which the anvil is secured 180° in order to move the anvil in a direction toward the cable when the cutter device is secured onto a cable. In this position the clamping arm will be within the cutout 21. The anvil is free to rotate about the eccentric pin and is held in place within the slot 16 in the device by use of a tapered pin 31 that fits into matching holes 24 within sections 11 and 12. Section 11 is also provided with a U-connector 33 by which the cutter device is secured to an instrument by use of a chain 34 or some other suitable means.

Section 12 is shorter in length than section 11 and the extended face 14 has a cutout 35 with the same depth as the width of the slot formed between the two sections. A cutter blade 36 is secured in the cutout section by screw 37 and is provided with a rounded facial surface 38 near the axis of the device which clamps against the cable that lies between the anvil and the cutter blade. The rounded facial surface is an eccentric with the radius at "*a*" less than the radius at "*b*" so that the frictional pull between the rounded surface and the cable will increase as the cable is pulled through the device. The cutter is provided with a cutting edge 41 that is positioned away from the cable about 90°. The cutter is rotated 90° by action of the cable so that the cutter blade is forced into the cable thereby cutting the cable as the cable pulls through the cutter device rotating and forcing the blade to cut the cable. The cutter is provided with a hole 42 near screw 37 through which a shear pin 43 fits in order to hold the cutter in place against accidental movement.

Figure 6:
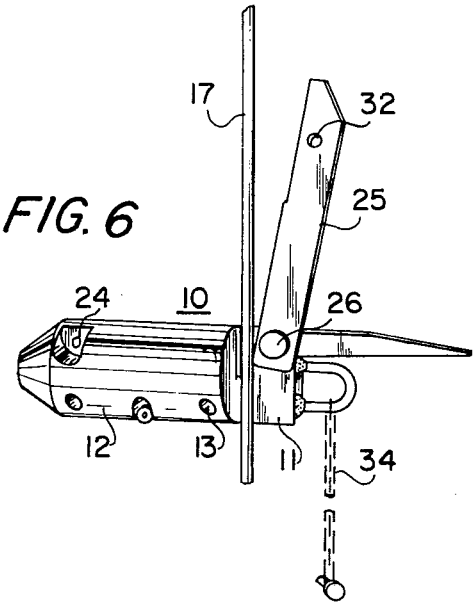
FIG. 6–10 illustrates the method of securing the fail-safe cutter device onto the cable near an instrument to be saved.
Figure 7:
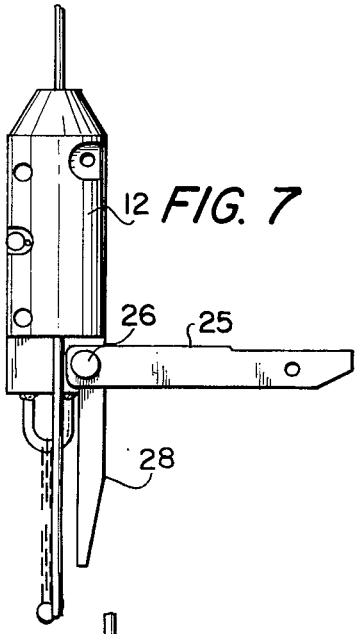
Figure 8:
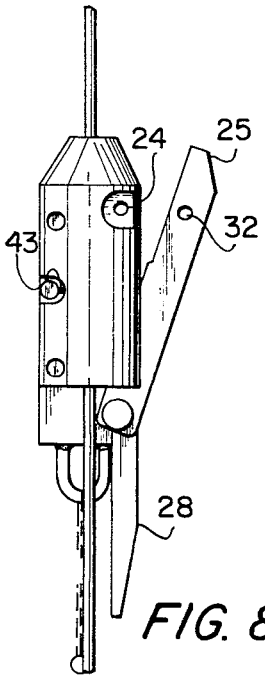
Figure 9:
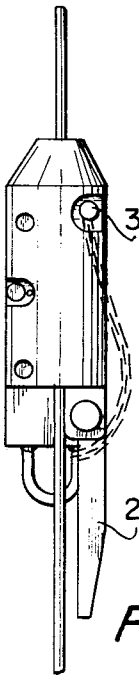
Figure 10:
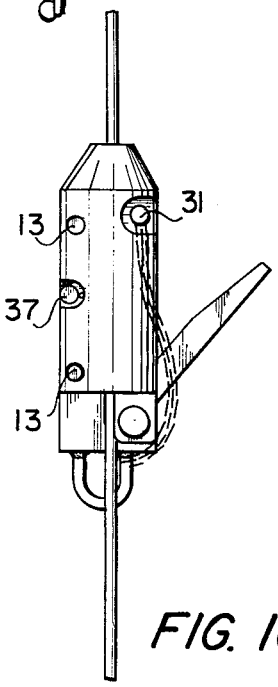

The fail-safe cutter device may be placed onto the cable near the instrument after the cable has been threaded through the pulley and connected to the instrument. FIG. 6 illustrates the cutter device placed along side the cable near the instrument with the slotted side toward the cable, with the cable between the end of the short section 12 and the anvil 25. The anvil 25 is substantially parallel with the cable and the clamping arm 28 is aligned with the length of the cutter device. The cutter device is rotated 90° so that the cable 17 lies along the linear axis of the cutter device (FIG. 7). In this position, the rounded edge 38 of the cutter will be adjacent the cable. FIG. 8 illustrates the anvil being rotated 90° into place within the slot 16, FIG. 9. A retaining pin 31 is placed in the hole 24 and through a hole 32 in the upper end of the anvil into hole 24 of section 12 to secure the anvil in place within the slot. The clamping arm 28 is rotated 180° to the closed position within the cutout 21 simultaneously rotating the eccentric pin 180° thereby forcing the anvil further into the slot and clamping the cable more firmly between the rounded edge of the cutter blade and the flat edge of the anvil. The anvil and cutter blade have the same width which is equal to or slightly wider than the diameter of the cable.

In use of the fail-safe cutter device, one must be insured that the fail-safe cutter device is secured to the instrument to be saved. Therefore a safety chain 34 is connected between the U-connector and the instrument with sufficient slack in the chain so that the instrument load is carried by the cable rather than the chain. Once the cable has been cut, there is nothing except the chain to hold the cable to the cutter device therefore a requirement for the chain or some such safety means. After connecting the chain to the instrument, the fail-safe cutter device is then connected to the cable as displayed by FIGS. 6–10.

The functional operation of this fail-safe cutter device is as described in U.S. Pat. No. 3,446,484 and shown in an operational sequence in FIGS. 1–4 therein. Once the cutter device of this invention is "two-blocked," the cutter device is stopped by the pulley and the cable slides through the cutter device due to the pull of the winch. As the cable is pulled through the cutter device, the friction between the cutter blade and the cable causes rotational movement of the cutter blade. As the cutter blade rotates, the shear pin breaks permitting free rotational movement of the cutter blade. The cutter blade rotates by relative movement of the cable until the cutting edge of the blade contacts the cable. Further, movement of the cable forces the cutting edge into the cable further until sufficient movement of the cable causes the cutting edge to completely sever the cable. As the cut cable pulls free of the fail-safe cutter device, the instrument pulls the device downwardly away from the pulley due to the pull of gravity. The bale is in its normal position below the safety device thereby catching the safety device as it falls. The safety device is locked-in above the small end of the bale therefore the instrument will be suspended from the pulley as shown in U.S. Pat. No. 3,446,484, FIG. 4.

The fail-safe cutter device may be connected with the instrument and to the cable with the cable already connected to the instrument. The cutter device is automatically secured to the cable when placed thereon, therefore there is no requirement for any welding, soldering, etc. There is no fusion of the cutter device to the cable as in the prior patent.

Obviously many modifications and variations of the present invention are possible in light of the above teachings. It is therefore to be understood that within the scope of the appended claims the invention may be practiced otherwise than as specifically described.

What is claimed and desired to be secured by letters patent of the United States is:

1. A fail-safe cutter device for securing onto a cable and preventing loss of a payload due to "two-blocking" which comprises:

a cylindrical elongated member having a conical upper end section;

a first slot along the length of said cylindrical member along a diameter thereof with equal dimensions on each side of the diameter;

said slot extending from the outer surface through the axis of said member to a depth greater than the radius of said cylindrical member thereby forming first and second substantially semi-cylindrical sections;

said first semi-cylindrical section having a length which is less than that of said second section;

a second linear slot having the same width as said first slot extending from the opposite outer surface of said cylindrical member toward the axis thereof joining said first slot in alignment therewith;

a cutter secured within said second slot and adapted for rotational movement relative to the axis of said cylindrical member;

an anvil of substantially the same length as said second section secured at one end to said second semi-cylindrical section below the lower end of said first section for rotational movement into said first slot;

a clamping arm secured relative to said second semi-cylindrical section parallel with said anvil for movement relative to said second section;

an eccentric pin;

said eccentric pin securing said anvil to said second section with said clamping arm fixedly secured to said eccentric for rotation therewith;

means for securing said anvil within said first slot relative to said cutter;

whereby a cable along the axis of said cutter device will be clamped between said cutter and said anvil.

2. A fail-safe cutter device as claimed in claim 1; wherein, said cylindrical member is formed by two substantially semi-cylindrical members secured together.

3. A fail-safe cutter device as claimed in claim 2; wherein, said second slot is formed by a cutout in said first substantially semi-cylindrical member.

4. A fail-safe cutter device as claimed in claim 3; wherein, said cutter includes a circular portion which is normally positioned to clamp the cable between said circular portion and said anvil; and a cutting edge which is normally about 90° removed from said cable when in its non-cutting position.

* * * * *